US009717379B2

(12) United States Patent
Denis et al.

(10) Patent No.: US 9,717,379 B2
(45) Date of Patent: Aug. 1, 2017

(54) DISPENSER FOR DISPENSING A SELECTABLE QUANTITY OF ABSORBENT SHEET PRODUCTS

(71) Applicant: SCA TISSUE FRANCE, Saint-Ouen (FR)

(72) Inventors: Yoann Denis, Muttersholtz (FR); Karine Papin, Horbourg-Wihr (FR); Loïc Sieber, Rixheim (FR); Matti Ellonen, München (DE)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 15/034,584

(22) PCT Filed: Nov. 15, 2013

(86) PCT No.: PCT/IB2013/003089
§ 371 (c)(1),
(2) Date: May 5, 2016

(87) PCT Pub. No.: WO2015/071702
PCT Pub. Date: May 21, 2015

(65) Prior Publication Data
US 2016/0316977 A1 Nov. 3, 2016

(51) Int. Cl.
*B65G 47/14* (2006.01)
*B65G 59/00* (2006.01)
(Continued)

(52) U.S. Cl.
CPC ..... *A47K 10/422* (2013.01); *A47K 10/427* (2013.01); *B65D 83/0817* (2013.01)

(58) Field of Classification Search
CPC ..... A47F 9/042; A47F 1/121; A47F 13/085; A47F 1/04; B65D 83/08; B65D 83/0817; A47K 10/422; A47K 10/427
(Continued)

(56) References Cited

U.S. PATENT DOCUMENTS 2,656,916 A * 10/1953 Henderson ..... B65D 83/0894 221/50
3,068,055 A * 12/1962 Lenzi ..... A47K 10/422 221/59
(Continued)

FOREIGN PATENT DOCUMENTS

DE 1511978 A1 12/1969
JP 2003205981 A 7/2003

OTHER PUBLICATIONS

EP Application No. 13 836 216.5—EP Official Communication mailed Mar. 21, 2017.

*Primary Examiner* — Rakesh Kumar
(74) *Attorney, Agent, or Firm* — Drinker Biddle & Reath LLP

(57) ABSTRACT

A dispenser for dispensing a selectable quantity of absorbent sheet products is provided. The dispenser includes a container for containing a stack of absorbent sheet products, and an opening through which at least one absorbent sheet product is graspable. The opening includes a main portion in a first side of the container and at least one additional portion extending the main portion towards a second side of the container such that the, at least one, additional portion extends above and transversally relatively to the stack of absorbent sheet products contained in the container. The, at least one, additional portion defines multiple exposing zones along an axis (x) from one end of the main portion towards another end of the main portion. Each additional portion has a length from the axis (x) being associated with a maximum
(Continued)

amount of absorbent sheet products graspable at the same time in a single seizure by a user.

5 Claims, 3 Drawing Sheets

(51) Int. Cl.
*G07F 11/00* (2006.01)
*A47K 10/42* (2006.01)
*B65D 83/08* (2006.01)

(58) Field of Classification Search
USPC ..... 211/12; 221/47, 45, 1
See application file for complete search history.

(56) References Cited

U.S. PATENT DOCUMENTS 3,272,385 A 9/1966 Watkins
3,307,740 A * 3/1967 Fant ..... A47K 10/42 221/282
3,970,215 A * 7/1976 McLaren ..... A47K 10/421 206/233
4,191,307 A * 3/1980 LeCaire, Jr. ..... A47K 10/3827 206/409
4,356,950 A * 11/1982 Benham ..... B65D 5/728 206/443
4,491,242 A 1/1985 Trinidad
4,790,436 A * 12/1988 Nakamura ..... B65D 83/0805 206/449
4,805,800 A * 2/1989 Nocek ..... B65D 83/0894 206/554
5,368,165 A * 11/1994 Ngyuen ..... B65D 83/0852 206/494
5,509,570 A * 4/1996 DeMatteis ..... B65D 83/08 221/303
5,857,586 A * 1/1999 Scherr ..... B65D 33/14 206/554
6,098,806 A * 8/2000 Mills ..... B65D 33/001 206/494
6,401,971 B1 * 6/2002 Edwards ..... B65D 5/5007 221/26
6,422,416 B1 * 7/2002 Tramontina ..... A47K 10/424 221/45
6,655,546 B1 * 12/2003 Bolton ..... B65D 83/0847 206/554
6,779,683 B2 * 8/2004 Taylor ..... A47K 10/424 221/47
7,175,025 B2 * 2/2007 Chum ..... B65D 83/0847 206/449
7,275,657 B2 * 10/2007 Geyer ..... A47F 9/042 221/33
7,845,515 B2 * 12/2010 Moody ..... A47K 10/424 221/36
8,210,354 B2 * 7/2012 Alvarado ..... A47F 13/085 206/554
8,567,618 B2 * 10/2013 Tan ..... A47F 9/042 211/85.15
2002/0063136 A1 * 5/2002 Sauer ..... A47K 10/42 221/1
2003/0224962 A1 * 12/2003 Fryc ..... B65D 83/0847 510/438
2004/0040974 A1 * 3/2004 Chen ..... B65D 83/0805 221/63
2005/0189366 A1 * 9/2005 Sommers ..... B65D 5/48024 221/34
2006/0273107 A1 * 12/2006 Keberlein ..... A47K 10/424 221/305
2007/0181594 A1 * 8/2007 Thompson ..... A47K 10/40 221/190
2011/0259908 A1 10/2011 Case et al.
2013/0153593 A1 * 6/2013 Silagy ..... B65D 83/0817 221/1
2015/0076169 A1 * 3/2015 Tan ..... A47F 9/042 221/1

* cited by examiner

DISPENSER FOR DISPENSING A SELECTABLE QUANTITY OF ABSORBENT SHEET PRODUCTS

CROSS-REFERENCE TO PRIOR APPLICATION

This application is a §371 National Stage Application of PCT International Application No. PCT/IB2013/003089 filed Nov. 15, 2013, which is incorporated herein in its entirety.

TECHNICAL FIELD

The disclosure relates to a dispenser for dispensing a selectable quantity of absorbent sheet products. The absorbent sheet products may be manufactured from a web of tissue paper (obtained by a Conventional Wet Press or Through Air Drying manufacturing method or other manufacturing method) or a nonwoven fabric (obtained by an air-laid manufacturing method or spun-laid manufacturing method or other manufacturing method). Such absorbent sheet products find a particular, though non exclusive, use as sanitary or domestic purposes. As an example, such absorbent sheet products may be used as napkins in quick service restaurant. Others uses as towels, bath tissues, etc. . . . may be possible.

BACKGROUND

A tissue paper relates to an absorbent paper based on cellulose fibers which is also called tissue paper base-sheet in this field of technology. A typical absorbent paper has a low basis weight, in the range from 10 to 50 g/m$^2$.

A nonwoven fabric comprising cellulosic fibers relates to an absorbent paper which is also called nonwoven or web made of fibers like air-laid web in this field of technology. A typical absorbent paper has a basis weight, in the range from 30 to 250 g/m$^2$, or 40 to 200 g/m$^2$.

There exist various types of dispensers for dispensing absorbent sheet products to users. Often, such dispensers are provided in restaurants (e.g. fast food also known as quick service restaurants) or other public places. The users remove an amount of absorbent sheet products from the dispenser. The capacity of such dispenser may be adapted to the intended use. For example, in the context of a quick service restaurant, a large number of napkins may be dispensed in a short period of time to an important number of users. However, in such a context, this often results in difficulty to uniformly dispense a controlled number of napkins that is sufficient for the needs of the users, and/or a reasonable number of napkins that is not larger than necessary for the needs of the users. It is particularly difficult for a user to control the number of napkins dispensed in one grasping movement. In the context of, for example, fast food restaurants, as the dispensing must be done quickly, it is unthinkable to count the number of dispensed napkins in one grasping movement. There is a compromise between the overconsumption of napkins, and the gain or loss of time due to the dispensing.

Document US 2011/0259908 describes a sheet product dispenser including a body portion defining an inner cavity arranged to support a stack of sheet products and a faceplate attached to the body portion. The faceplate portion is arranged to support and dispense the sheet products, has an opening including a rectangular portion with a centrally disposed arcing triangular portion having a centrally disposed arced apex, the rectangular portion extends from an upper edge of the faceplate to the arced apex, the opening is arranged to expose a plurality of the sheet products on one end of the body portion through the rectangular portion and to expose a planar surface of a single sheet product through the arcing triangular portion. Thus, this dispenser is adapted to dispense a quantity of sheet products in a sequential fashion (i.e. one by one until the desired quantity is attained). However, this dispenser is not adapted to dispense a defined quantity of sheet products in one grasping movement, said defined quantity being selected by the user and uniformly reproducible over time.

There remains a desire to improve quality of dispensing, uniformity of dispensing, selection of the quantity to be dispensed in one single grasping movement and also to avoid wasting absorbent sheet products that are unnecessary to the users. Further, this should be obtained in economical or cost effective manner.

SUMMARY

A dispenser for dispensing a selectable quantity of absorbent sheet products in one single grasping movement that overcomes the drawbacks of the prior art dispenser is desired. In particular, it is desirable to improve uniformity of dispensing of absorbent sheet products to a user.

According to one aspect, there is provided a dispenser for dispensing a selectable quantity of absorbent sheet products, the dispenser including a container for containing a stack of absorbent sheet products, and an opening through which at least one absorbent sheet product is graspable. The opening includes a main portion in a first side of the container, and further includes at least one additional portion extending the main portion towards a second side of the container such that the, at least one, additional portion extends above and transversally relatively to the stack of absorbent sheet products contained in the container. The, at least one, additional portion defines multiple exposing zones along an axis from one end of the main portion towards another end of the main portion. Each additional portion has a length from the axis being associated with a maximum amount of absorbent sheet products graspable at the same time in a single seizure by a user.

The opening may include at least first and second, additional portions, the first portion having a first length associated with a first exposing zone corresponding to a first maximum amount of graspable absorbent sheet products, the second portion having a second length different from the first length associated with a second exposing zone corresponding to a second maximum amount of graspable absorbent sheet products.

The at least first and second additional portions may be positioned separated from each other onto the second side of the container.

The at least first and second additional portions may be positioned contiguous to each other onto the second side of the container according to a stairway shape.

The opening may include a single additional portion having a length varying continuously along the axis from a first length at an end of the main portion towards a second length at another end of the main portion, the length of the additional portion at a determined position of the main opening being associated with a determined exposing zone corresponding to a determined maximum amount of graspable absorbent sheet products.

The width of the, at least one, additional portion may be sufficient for a user finger to be inserted within the container.

The main portion of the opening may be positioned in a face-plate of the container.

The, at least one, additional portion may be positioned in a top-plate of the container.

The, at least one, additional portion may be associated with at least one indicator indicating the maximum amount of graspable absorbent sheet products related to a corresponding exposing zone. The indicator may be a number, a symbol or a color.

According to another aspect, there is provided a use of the dispenser described above for dispensing absorbent sheet products, such as napkins, towels, kitchen towels, hand towels, toilet papers, wipes or facial tissues.

With the herein described dispensers, it is possible to dispense a certain amount of napkins with every grasping movement, said amount being selectable by the user. For example, a user may choose to dispense one napkin, three napkins or six napkins depending on the chosen exposing zone in one grasping movement. This is of particular interest in the context of quick service restaurant applications.

The herein described dispensers also well adapted to uniformly dispense a selectable and controlled amount of paper products from a large dispenser without dispensing more paper products than necessary to a user. This enables limiting the quantity of paper products that is removed by a user, and thus limiting waste of paper products.

Further, reducing the waste of consumption results in economical and environmental benefits, as similar or even better satisfaction of the users is obtained while using fewer paper products.

Other advantages will become apparent from the hereinafter description of the invention.

BRIEF DESCRIPTION OF THE DRAWINGS

Embodiments of the invention are illustrated by way of examples and not limited to the accompanying drawings, in which like references indicate similar elements.

DETAILED DESCRIPTION OF PARTICULAR EMBODIMENTS

Figure 1:
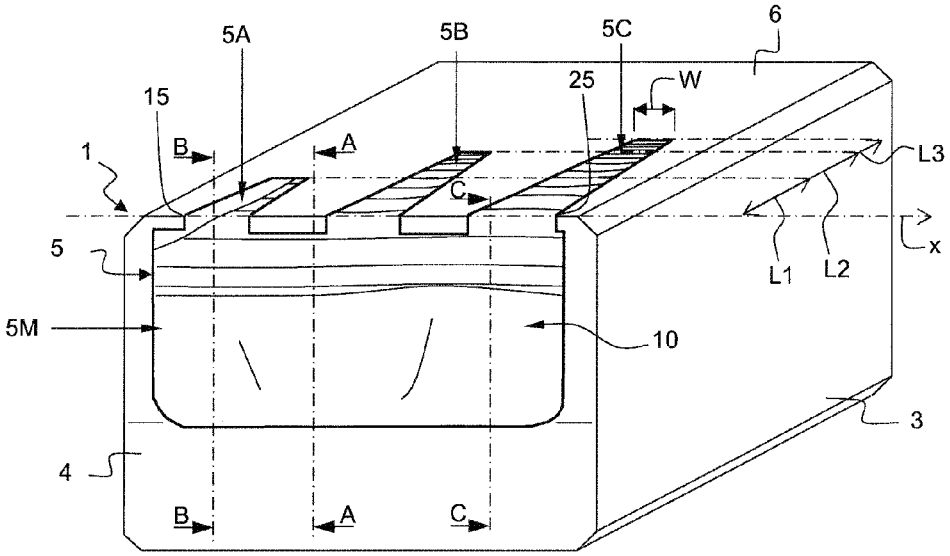
FIG. 1 is a front perspective view schematically illustrating a first exemplary embodiment of a dispenser for dispensing absorbent sheet products.
Figure 2:
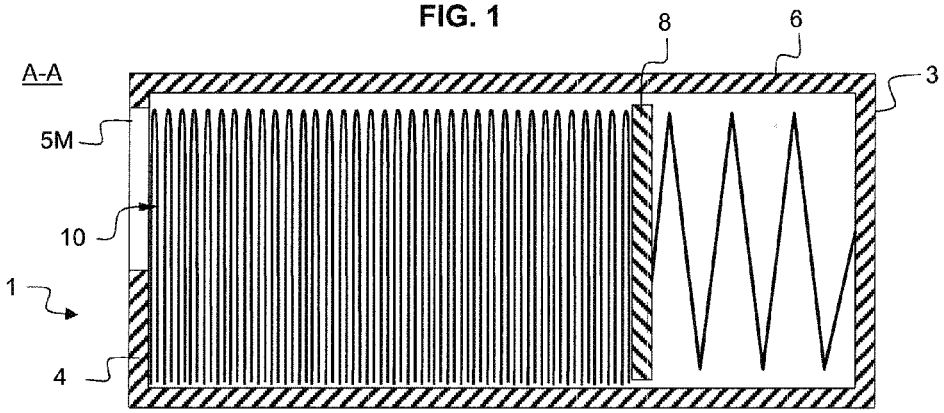
FIGS. 2, 3 and 4 are side cross-section and partial side cross-section views of the first exemplary embodiment depicted in FIG. 1.
Figure 3:
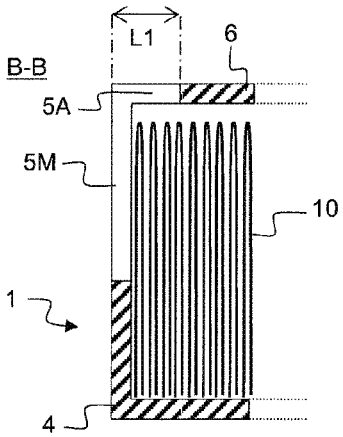
Figure 4:
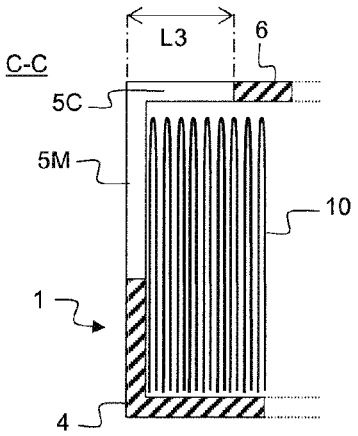

FIG. 1 is a front perspective view schematically illustrating a first exemplary embodiment of a dispenser 1 for dispensing absorbent sheet products 10. The first exemplary embodiment is a horizontal dispenser 1. FIG. 2 is a lateral cross-section view according to the line A-A of the front perspective view also schematically illustrating the horizontal dispenser 1. FIGS. 3 and 4 are partial side cross-section views according to the lines B-B and C-C of the first exemplary embodiment depicted in FIG. 1, respectively. The dispenser 1 includes a container 3 of substantially parallelepiped shape orientated horizontally, an opening 5, and a mechanism 8 for pushing the absorbent sheet products 10 towards the opening 5. The opening 5 includes a main portion 5M positioned in a first side of the container 3. For example the main portion 5M of the opening 5 is provided in a face-plate 4 of the container 3. The container may be filled in with a stack of absorbent sheet products 10, for example a stack of napkins, each napkin being positioned vertically such as to expose a planar surface of the individual sheet through the main portion 5M of the opening 5. The main portion 5M of the opening 5 partially opens the face-plate 4 so as to retain the first absorbent sheet product 10 while at the same time ease a user access to said absorbent sheet product 10. As an example, the face-plate 4 with the main portion 5M has a general U-shape. The opening 5 further includes at least one additional portion, for example, as depicted in the embodiment of FIG. 1, three additional portions 5A, 5B, 5C extending the main portion 5M towards a second side of the container 3. For example, the additional portions 5A, 5B, 5C of the opening 5 are provided in a top-plate 6 of the container 3. The three additional portions 5A, 5B, 5C extends above and transversally relatively to the planar surface of each individual sheet of the stack of absorbent sheet products 10 contained in the container 3. That means also that the three additional portions 5A, 5B, 5C extends onto the top-plate 6 transversally relatively to an axis x. The axis x extends longitudinally all along the opening and parallel to the face-plate 4. In these embodiments, the axis x is horizontal.

The first portion 5A has a first length L1. The first portion 5A defines a first exposing zone of a first maximum amount of graspable absorbent sheet products. For example, said first maximum is three, meaning that a user may grasp one or two absorbent sheet products and only grasp at the maximum three absorbent sheet products when using the first portion 5A of the opening. The second portion 5B has a second length L2 greater than the first length L1. The second portion 5B defines a second exposing zone, of a second maximum amount of graspable absorbent sheet products. For example, said second maximum is four, meaning that a user may only grasp at the maximum four absorbent sheet products when using the second portion 5B of the opening. The third portion 5C has a third length L3 greater than the second length L2. The third portion 5C defines a third exposing zone of a third maximum amount of graspable absorbent sheet products. For example, said third maximum is six, meaning that a user may grasp five absorbent sheet products and only grasp at the maximum six absorbent sheet products when using the third portion 5C of the opening.

In the exemplary embodiment of FIG. 1, the first, second and third additional portions 5A, 5B, 5C are positioned separated from each other onto the top-plate 6 of the container 3.

The width W of the additional portion 5A, 5B, 5C is sufficient for a user finger to be inserted within the container.

A user may select a quantity of absorbent sheet products to be dispensed by choosing the additional portion 5A, 5B or 5C to be used. Then the user may grasp the maximum amount of absorbent sheet products graspable at the same time in a single seizure simply by seizing a portion of the stack of absorbent sheet products between two fingers, one finger laid on the front panel gaping from the opening at the face-plate 4 and another finger inserted at the end of the selected additional portion between two adjacent absorbent sheet products. Then, in one grasping movement, the user is able to grasp the maximum amount of absorbent sheet products out of the dispenser. Then, the mechanism 8 pushes the stack of absorbent sheet products 10 towards the face-plate 4 of the container 3.

Though FIGS. 1 to 4 schematically illustrate a horizontal dispenser, this dispenser may also be disposed in a vertical configuration (not shown). A vertical dispenser may be integrated into, e.g. positioned under a table so as to dispense the napkins (or other products like toilet papers) through an appropriate hole of the table. In this case, the dispenser must protrude over the table at least above the additional portions 5A, 5B, 5C in order to maintain the functionality of said additional portions of the opening 5.

Figure 5:
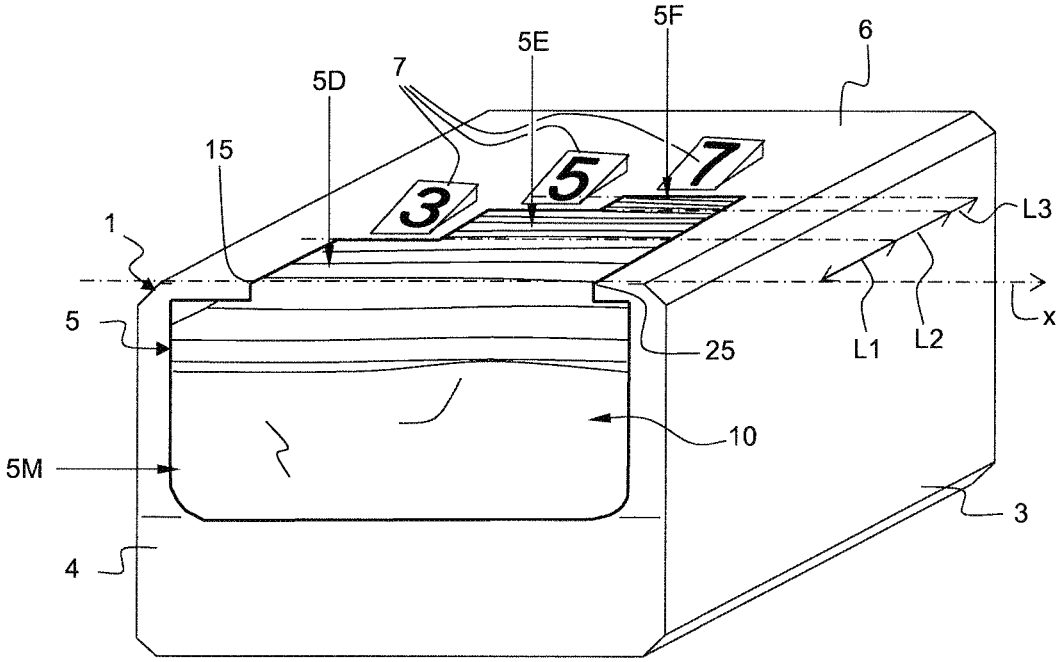
FIG. 5 is a front perspective view schematically illustrating a second exemplary embodiment of a dispenser for dispensing absorbent sheet products.

FIG. 5 is a front perspective view schematically illustrating a second exemplary embodiment of a dispenser 1 for dispensing absorbent sheet products. The dispenser 1 according to the second exemplary embodiment differs from the first exemplary embodiment in that the first, second and third additional portions 5D, 5E, 5F are positioned contiguous to each other onto the top-plate 6 of the container 3 such as to form a stairway-like shape.

Further, each additional portion 5D, 5E, 5F may be associated with a corresponding indicator 7 visually indicating the maximum amount of graspable absorbent sheet products related to a corresponding exposing zone. As an example, a maximum of three absorbent sheet products may be seized from the exposing zone defined by the first additional portion 5D, a maximum of five absorbent sheet products may be seized from the exposing zone defined by the second additional portion 5E, and a maximum of seven absorbent sheet products may be seized from the exposing zone defined by the third additional portion 5F. In this particular example, the indicator is implemented in the form of a number corresponding to a maximum number of seizable absorbent sheet products; however any other kind of indicator like symbols, colors, dots, etc. . . . may be appropriate provided that each indicator is associated with such a maximum number of seizable absorbent sheet products. The indicator feature is not limited to this second exemplary embodiment and is applicable to all the embodiments.

Further, in the first and second exemplary embodiments, the depicted examples of three exposing zones defined by three additional portions are not limitative. Depending on the dispenser application, two or more additional portions may be provided in the top-plate 6 of the container 3.

Figure 6:
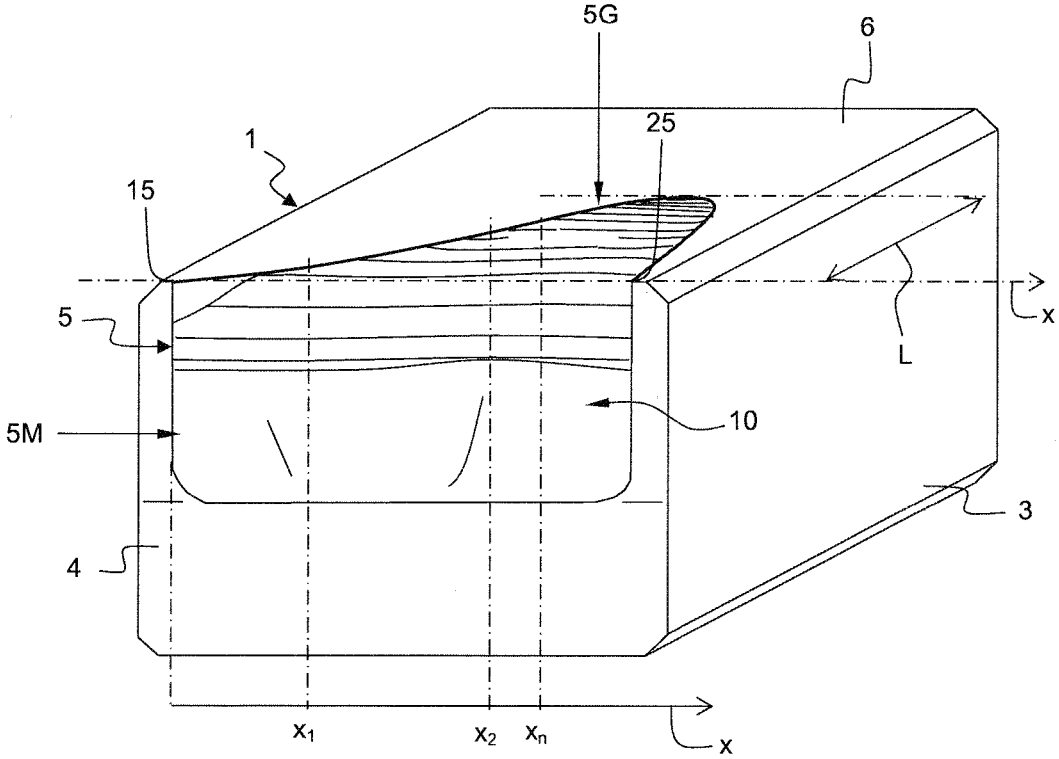
FIG. 6 is a front perspective view schematically illustrating a third exemplary embodiment of a dispenser for dispensing absorbent sheet products.

FIG. 6 is a front perspective view schematically illustrating a third exemplary embodiment of a dispenser 1 for dispensing absorbent sheet products. The dispenser 1 according to the third exemplary embodiment differs from the first and second exemplary embodiment in that it includes a single additional portion 5G of variable length instead of multiple additional portions of different length. The single additional portion 5G has a length varying continuously from a first length (e.g. 0) at one end 15 of the main portion 5M towards a second length (e.g. L) at another end 25 of the main portion 5M according to axis x. The length of the additional portion 5G at a determined position $x_n$ of the main opening 5M defines a determined exposing zone corresponding to a determined maximum amount of graspable absorbent sheet products. As an example, at the position $x_1$ closer to the end 15, the maximum amount of graspable absorbent sheet products may be three, while at the position $x_2$ closer to the other end 25, the maximum amount of graspable absorbent sheet products may be five.

Figure 7:
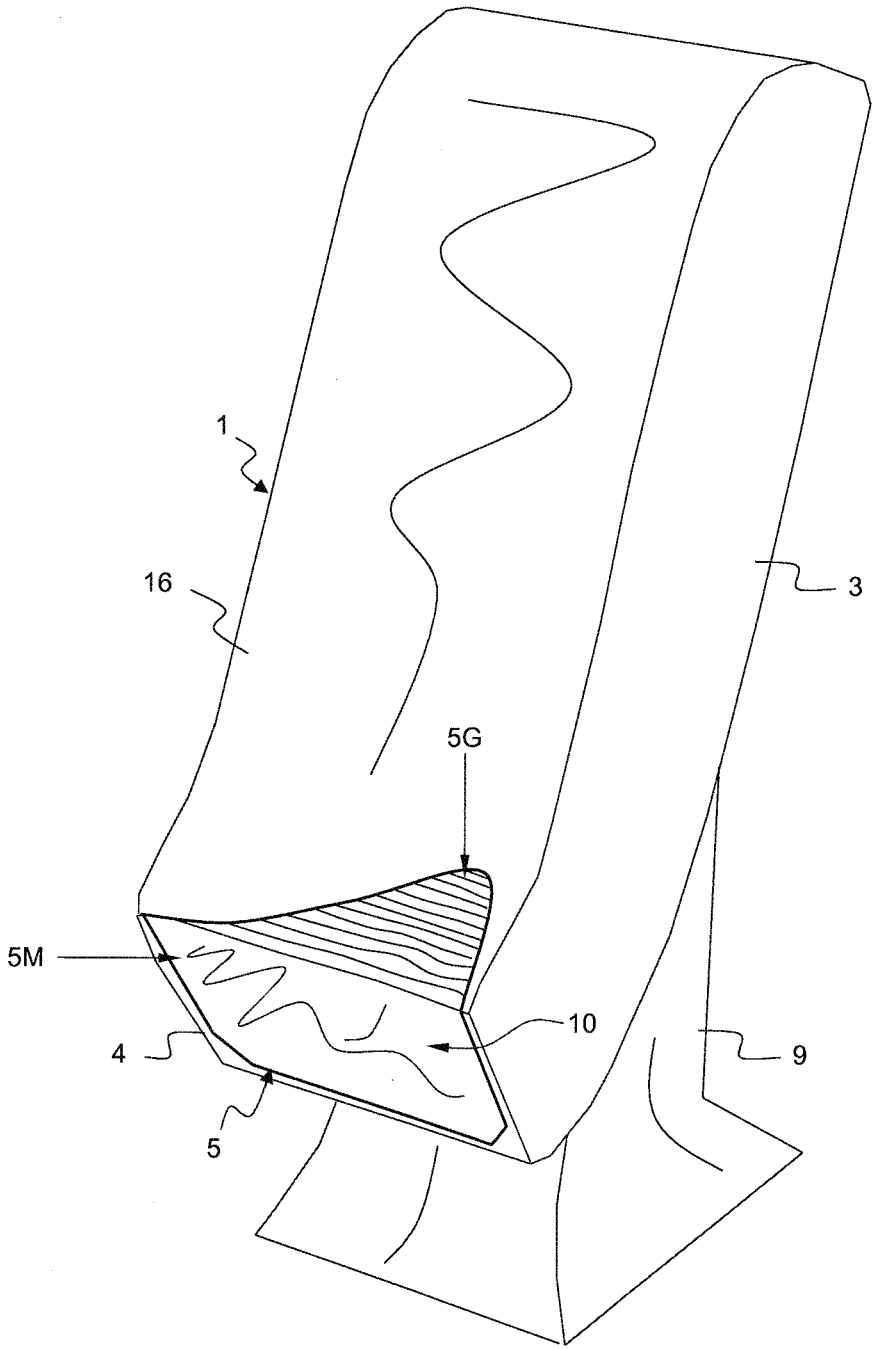
FIG. 7 is a front perspective view schematically illustrating a fourth exemplary embodiment of a dispenser for dispensing absorbent sheet products.

FIG. 7 is a front perspective view schematically illustrating a fourth exemplary embodiment of a dispenser 1 for dispensing absorbent sheet products. The dispenser 1 according to the fourth exemplary embodiment differs from the third exemplary embodiment in that the dispenser is a vertical dispenser (as a stand or in-counter or wall type or table-top dispenser). The dispenser 1 according to the fourth embodiment includes a pedestal member 9 supporting the container 3. The container 3 includes a front-plate 16 playing the role of the top-plate 6 of the first, second and third embodiment. Like the top-plate 6, the front-plate 16 may be coupled to the side walls of the containers 3 through any appropriate connection arrangement (e.g. hinge arrangement, snap-fit arrangement, etc. . . . that is not shown in the FIGS.) in order to give access inside the container 3 for absorbent sheet products refilling operations.

The hereinbefore depicted exemplary embodiments may be used for dispensing stack of absorbent sheet products like napkins that can be used in e.g. quick service restaurant. The napkins are grouped as a stack that fills-in the container of the dispenser. The stack of napkins is properly positioned in the dispenser so that when a user grasps a group of napkins in dependence of a selected exposing zone, all the napkins of a group can be seized at the same time. Thus, the user may obtain a selectable quantity of napkins in one grasping movement.

The drawings and their descriptions hereinbefore illustrate rather than limit the invention.

Though the invention has been described with respect to various embodiments of dispenser wherein the additional portions of the opening enable dispensing three, four, five, six and seven absorbent sheet products, these are not limitative examples. The skilled person will readily recognize that each additional portion of the opening may be adapted with respect to its length in dependence of the thickness of the individual absorbent sheet product to dispense other maximum amount of absorbent sheet products, e.g. two, three, four, ten, etc.

The particular application of the product as napkins in the frame of quick service restaurant application is only an example as numerous other sanitary or domestic applications are also possible (e.g. towels, kitchen towels, hand towels, toilet papers, wipes, facial tissues, bath tissues etc. . . . ).

Also the absorbent sheet product can be folded and may be folded according to various type of folding within the stack (interfolded or not, fold, ½ fold, ¼ fold, ⅛ fold, . . . V-fold, C-fold, M-fold, etc. . . . type of folding) if desired or deemed necessary with respect to, for example, the uniformity of dispensing, the practicality or even the desired aesthetic effect to be achieved. The absorbent sheet product may also be interfolded.

Any reference sign in a claim should not be construed as limiting the claim. The word "comprising" does not exclude the presence of other elements than those listed in a claim. The word "a" or "an" or "at least one" preceding an element does not exclude the presence of a plurality of such element.

The invention claimed is:

1. A dispenser for dispensing a selectable quantity of absorbent sheet products, comprising:

a container for containing a stack of absorbent sheet products; and an opening through which at least one absorbent sheet product is graspable, the opening comprising:

a main portion in a first side of the container; and at least first and second additional portions extending the main portion towards a second side of the container such that said at least first and second additional portions extend above and in a transverse direction relative to the stack of absorbent sheet products contained in the container, the first portion having a first length in the transverse direction associated with a first exposing zone corresponding to a first maximum amount of absorbent sheet products, the second portion having a second length in the transverse direction different from the first length associated with a second exposing zone corresponding to a second maximum amount of graspable absorbent sheet products, wherein said at least first and second additional portions are positioned separated from each other along a first axis by a portion of the second side of the container in between.

2. The dispenser according to claim 1, wherein the width of said at least one additional portion is sufficient for a user finger to be inserted within the container.

3. The dispenser according to claim 1, wherein the main portion is positioned in a face-plate of the container.

4. The dispenser according to claim 1, wherein said at least one additional portion is positioned in a top-plate of the container.

5. A method of using the dispenser according to claim 1, comprising dispensing from the dispenser absorbent sheet products chosen from the group consisting of napkins, towels, kitchen towels, hand towels, toilet papers, wipes, and facial tissues.

* * * * *